US009939745B2

(12) United States Patent
Okuda et al.

(10) Patent No.: US 9,939,745 B2
(45) Date of Patent: Apr. 10, 2018

(54) CONDUCTIVE SUPPORT FOR ELECTROPHOTOGRAPHIC PHOTORECEPTOR, ELECTROPHOTOGRAPHIC PHOTORECEPTOR, AND IMAGE FORMING APPARATUS

(71) Applicant: FUJI XEROX CO., LTD., Tokyo (JP)

(72) Inventors: Shiori Okuda, Kanagawa (JP); Hiroaki Ogawa, Kanagawa (JP); Akihiko Nakamura, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/450,082

(22) Filed: Mar. 6, 2017

(65) Prior Publication Data

US 2018/0031986 A1 Feb. 1, 2018

(30) Foreign Application Priority Data

Jul. 28, 2016 (JP) ..... 2016-148925

(51) Int. Cl.

| | |
|---|---|
| ***G03G 5/00*** | (2006.01) |
| ***G03G 5/10*** | (2006.01) |
| ***G03G 15/00*** | (2006.01) |

(52) U.S. Cl.

CPC ..... *G03G 5/10* (2013.01); *G03G 5/102* (2013.01); *G03G 15/75* (2013.01)

(58) Field of Classification Search

CPC ..... G03G 5/10; G03G 5/102; G03G 15/75
USPC ..... 430/69
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Katsumi et al. | |
| 2007/0134569 | A1* | 6/2007 | Nakano | G03G 5/0433 430/56 |
| 2014/0044456 | A1 | 2/2014 | Yamashita et al. | |

FOREIGN PATENT DOCUMENTS

| | | | |
|---|---|---|---|
| EP | 0 710 893 | A1 | 5/1996 |
| JP | 4-189873 | A | 7/1992 |
| JP | 5-98181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 8-176293 | A | 7/1996 |
| JP | 8-208820 | A | 8/1996 |
| JP | 2004-078147 | A | 3/2004 |
| JP | 2005-181992 | A | 7/2005 |
| JP | 2012-155282 | A | 8/2012 |
| JP | 2014-38136 | A | 2/2014 |
| JP | 2016-004124 | A | 1/2016 |

* cited by examiner

*Primary Examiner* — Mark A Chapman
(74) *Attorney, Agent, or Firm* — Sughrue Mion, PLLC

(57) ABSTRACT

A conductive support for an electrophotographic photoreceptor includes a metallic cylindrical member. The conductive support has a bare area exposed even after a photosensitive layer is disposed on the conductive support, and the outer circumferential surface of at least part of the bare area has a surface residual stress of about −10 MPa or less.

17 Claims, 7 Drawing Sheets

CONDUCTIVE SUPPORT FOR ELECTROPHOTOGRAPHIC PHOTORECEPTOR, ELECTROPHOTOGRAPHIC PHOTORECEPTOR, AND IMAGE FORMING APPARATUS

CROSS-REFERENCE TO RELATED APPLICATIONS

This application is based on and claims priority under 35 USC 119 from Japanese Patent Application No. 2016-148925 filed Jul. 28, 2016.

BACKGROUND

Technical Field

The present invention relates to a conductive support for an electrophotographic photoreceptor, to an electrophotographic photoreceptor, and to an image forming apparatus.

SUMMARY

According to an aspect of the invention, there is provided a conductive support for an electrophotographic photoreceptor, the conductive support including a metallic cylindrical member, wherein the conductive support has a bare area exposed even after a photosensitive layer is disposed on the conductive support, and an outer circumferential surface of at least part of the bare area has a surface residual stress of about −10 MPa or less.

BRIEF DESCRIPTION OF THE DRAWINGS

Exemplary embodiments of the present invention will be described in detail based on the following figures, wherein.

DETAILED DESCRIPTION

Exemplary embodiments of the invention will next be described. The following description and Examples are only for illustrative purposes and not intended to limit the scope of the invention.

In the present disclosure, when the amount of a component including plural types of materials in a composition is referred to, the amount means the total amount of the plural types of materials in the composition, unless otherwise specified.

In the present disclosure, the "conductive support for an electrophotographic photoreceptor" may be referred to simply as a "conductive support," and the "electrophotographic photoreceptor" may be referred to simply as a "photoreceptor."

In the present disclosure, a "cylindrical member" is intended to encompass a hollow member and a solid member.

<Conductive Support for Electrophotographic Photoreceptor>

A conductive support according to an exemplary embodiment includes a metallic cylindrical member. The conductive support has a bare area exposed even after a photosensitive layer is disposed on the conductive support, and the outer circumferential surface of at least part of the bare area has a surface residual stress of about −10 MPa or less.

In the conductive support according to the present exemplary embodiment, the term "conductive" means that the support has a volume resistivity of less than $10^{13}$ Ωcm.

In the conductive support according to the present exemplary embodiment, the "bare area exposed even after the photosensitive layer is disposed" is present, for example, in opposite longitudinal end portions of the conductive support, and the length of each area is, for example, from 10% to 30% inclusive of the total length of the conductive support.

In the present exemplary embodiment, the "surface residual stress" is a residual stress measured by a $\sin^2 \psi$ method using an X-ray diffraction apparatus.

With the conductive support according to the present exemplary embodiment, the occurrence of image defects that occur when image formation is repeated is reduced. The reason for this may be as follows.

Figure 1:
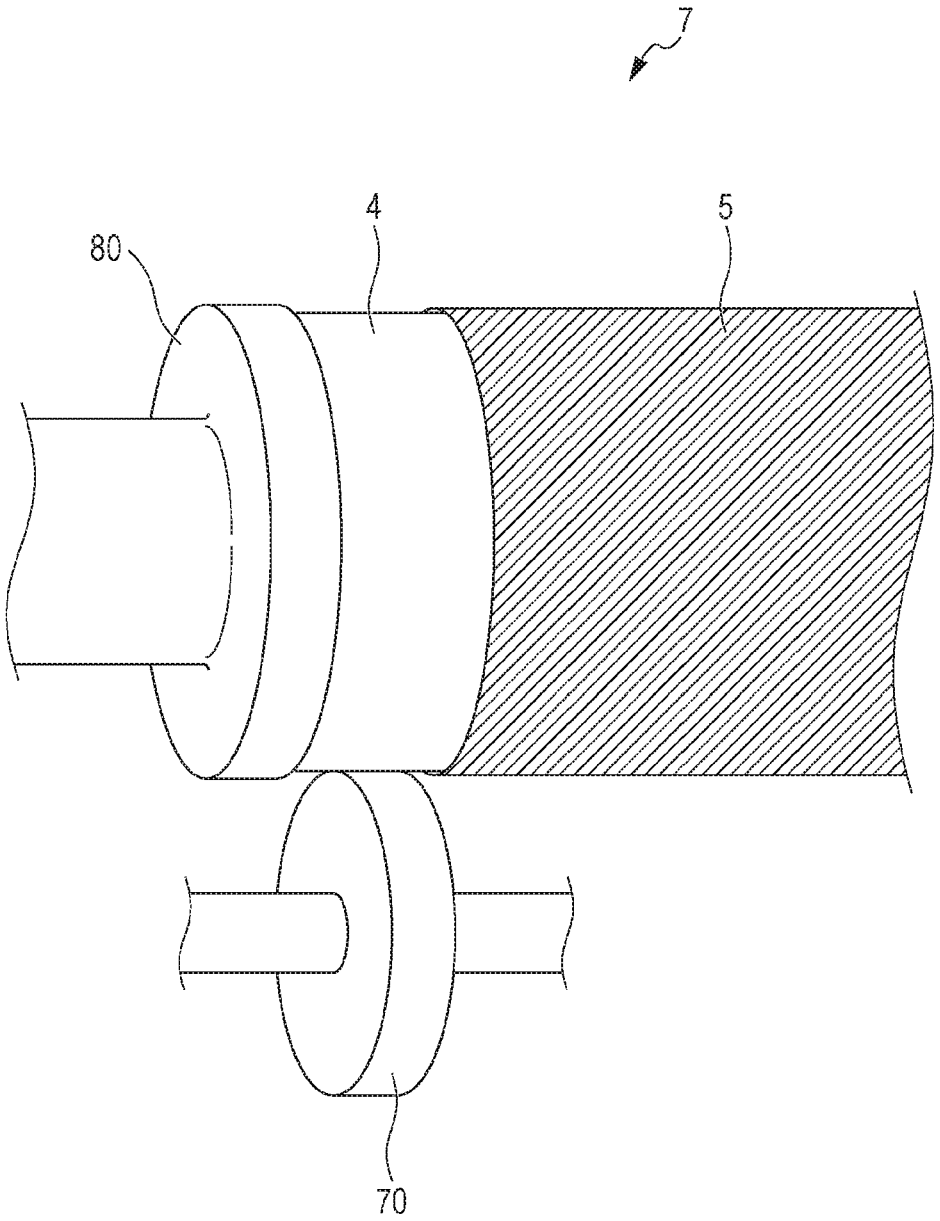
FIG. 1 is a schematic configuration diagram showing an example of the state in which a contact member is in contact with the outer circumferential surface of a conductive support included in an electrophotographic photoreceptor.

When the photoreceptor is attached to an image forming apparatus or a process cartridge, the outer circumferential surface of the conductive support included in the photoreceptor may come into direct contact with various components (hereinafter referred to as "contact members"). Examples of the contact members include a member for keeping the photoreceptor and a developing device separated from each other by a prescribed distance and a member for maintaining the position of the photoreceptor. FIG. 1 shows an example of the state in which a contact member is in direct contact with the outer circumferential surface of the conductive support. In the example shown in FIG. 1, the photoreceptor 7 is connected to a driving unit (not shown) through a supporting member 80. The contact member 70 is in contact with the outer circumferential surface of a bare area of the conductive support 4 on which the photosensitive layer 5 is not disposed to thereby keep the distance between the photoreceptor 7 and, for example, a developing device (not shown) within a prescribed range. The contact member 70 is, for example, a rotatable ring member. The outer circumferential surface of the ring is in direct contact with the outer circumferential surface of the conductive support 4, and the rotation of the photoreceptor 7 causes the contact member 70 to rotate together with the conductive support 4. When image formation is repeated using the image forming apparatus configured as described above, cracks may be formed on the outer circumferential surface of the conductive support 4 that is rubbed against the contact member 70, and wear of the conductive support 4 may start from the cracks. As a result of the wear, the distance between the photoreceptor 7 and the developing device changes, and this may cause image defects (such as density unevenness, poor gradation, and poor reproducibility of fine lines) to occur.

In the conductive support according to the present exemplary embodiment, the outer circumferential surface of at least part of the bare area exposed even after the photosensitive layer is disposed has a surface residual stress of about −10 MPa or less. The metal surface having a surface residual stress of about −10 MPa or less has a higher strength than a metal surface having a surface residual stress of more than −10 MPa, and cracks and wear are less likely to occur even after continuous friction with the contact object. Therefore, when the conductive support according to the present exemplary embodiment is mounted on an image forming apparatus and used as part of a photoreceptor and then image formation is repeated, the occurrence of image defects due to, for example, a change in the distance between the photoreceptor and the developing device may be suppressed.

In the conductive support according to the present exemplary embodiment, it is only necessary that the surface residual stress of the outer circumferential surface of at least part of the bare area exposed even after the photosensitive layer is disposed be about −10 MPa or less. In the conductive support according to the present exemplary embodiment, the surface residual stress of the outer circumferential surface of at least part of the bare area exposed even after the photosensitive layer is disposed may be about −10 MPa or less over the entire circumference.

The conductive support according to the present exemplary embodiment may be embodied in various forms including a form in which the outer circumferential surface of the entire bare area exposed even after the photosensitive layer is disposed has a surface residual stress of about −10 MPa or less and a form in which the entire outer circumferential surface of the conductive support has a surface residual stress of about −10 MPa or less.

In the conductive support according to the present exemplary embodiment, the outer circumferential surface of at least part of the bare area exposed even after the photosensitive layer is disposed has a surface residual stress of about −10 MPa or less, preferably about −15 MPa or less, more preferably about −20 MPa or less, and still more preferably about −30 MPa or less. A negative surface residual stress means that the surface residual stress is compressive residual stress and that cracks are less likely to be formed on the metal surface. From this point of view, the larger the surface residual stress in the negative direction, the more suitable.

In the conductive support according to the present exemplary embodiment, the surface residual stress of the outer circumferential surface is preferably about −70 MPa or more and more preferably about −50 MPa or more, from the viewpoint of suppressing deformation and an increase in surface roughness due to surface modification performed for the purpose of controlling the surface residual stress.

Examples of the metal forming the conductive support include: pure metals such as aluminum, iron, and copper; and alloys such as stainless steel and aluminum alloys. The metal forming the conductive support is preferably a metal containing aluminum because of its lightweight and good workability and more preferably pure aluminum or an aluminum alloy. No particular limitation is imposed on the aluminum alloy, so long as it is an alloy containing aluminum as a main component. Examples of the aluminum alloy include aluminum alloys containing, in addition to aluminum, for example, any of Si, Fe, Cu, Mn, Mg, Cr, Zn, Ti, etc. The "main component" is an element contained in the largest amount (based on weight) among the elements contained in the alloy. From the viewpoint of workability, the metal forming the conductive support is preferably a metal with an aluminum content (based on weight) of 90.0% or more, and the aluminum content is more preferably 95.0% or more and still more preferably 99.0% or more.

The conductive support is a cylindrical member and may be a hollow member or a solid member. To reduce the weight of the photoreceptor, the conductive support may be a hollow member. When the conductive support is a hollow member, its thickness (wall thickness) is, for example, from 0.2 mm to 0.9 mm inclusive, preferably less than 0.8 mm from the viewpoint of a reduction in weight of the photoreceptor, and more preferably 0.6 mm or less and is preferably 0.3 mm or more from the viewpoint of ensuring the strength of the conductive support and more preferably 0.4 mm or more.

The conductive support according to the present exemplary embodiment is manufactured by producing a metallic cylindrical member by known forming processing such as extrusion drawing, drawing, impact pressing, ironing, and machining and then subjecting at least part of a bare area exposed even after the photosensitive layer is disposed to surface modification by quenching, nitriding, burnishing, barrel polishing, or shot peening. From the viewpoint of reducing the wall thickness of the conductive support and from the viewpoint of the ease of control of the surface residual stress, a manufacturing method including subjecting a cylindrical tube formed by impact pressing and ironing to shot peening may be used.

The impact pressing is a working method including placing a metal block in a circular female die and striking the metal block with a cylindrical male die to thereby obtain a hollow cylindrical body conforming to the male die. After the hollow cylindrical body is obtained by the impact pressing, ironing is performed once or plural times to adjust the inner diameter, outer diameter, cylindricity, and roundness of the hollow cylindrical body to thereby obtain a cylindrical tube. The shot peening is a processing method in which particles (also referred to as "shots," "media," etc.) are injected with compressed air to cause the particles to collide with the metal surface to thereby modify the metal surface. If necessary, opposite ends of the cylindrical tube may be cut and subjected to end face treatment.

Exemplary embodiments of the impact pressing, ironing, and shot peening will be described below.

—Impact Pressing—

Figure 2A:
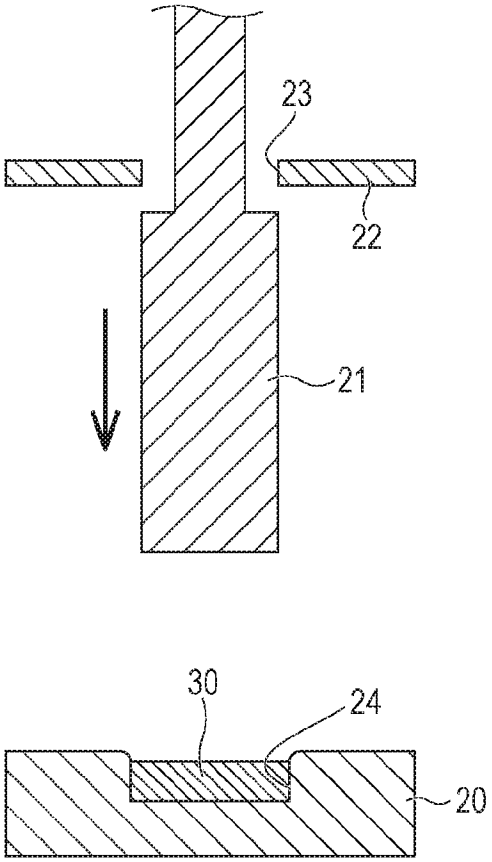
FIGS. 2A, 2B, and 2C are schematic diagrams showing an example of impact pressing for forming the conductive support.
Figure 2B:
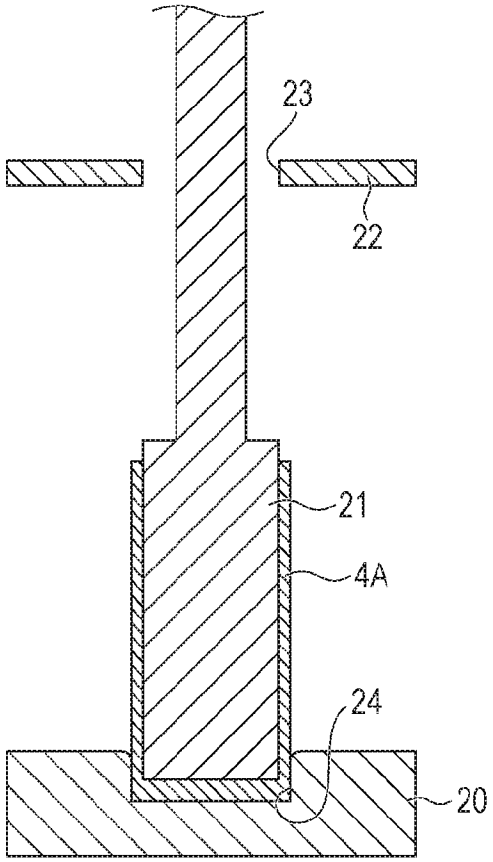
Figure 2C:
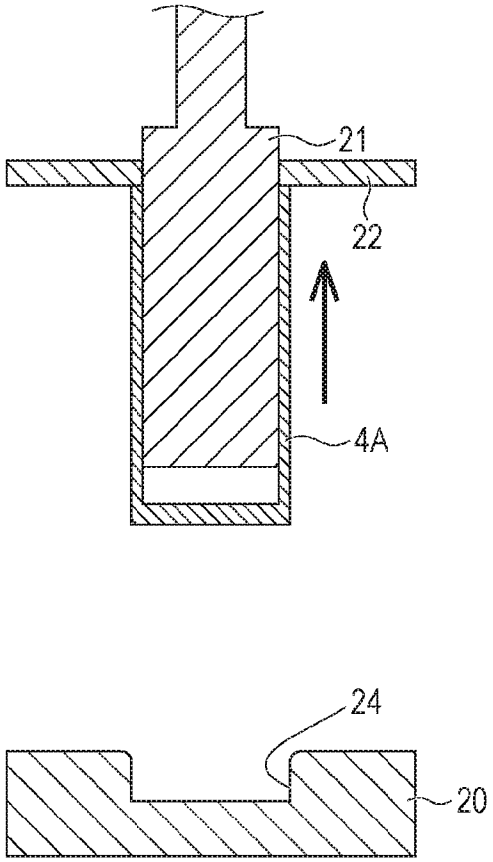

FIGS. 2A to 2C show an example of the process of subjecting a metal block to impact pressing to form a hollow cylindrical body. As shown in FIG. 2A, the disk-shaped metal block 30 with a lubricant applied thereto is placed in a circular hole 24 formed in a die (female die) 20. Next, as shown in FIG. 2B, the metal block 30 is subjected to pressing using a cylindrical punch (male die) 21 to form a hollow cylindrical body 4A. Next, as shown in FIG. 2C, the punch 21 is pulled up through a central hole 23 of a stripper 22 to pull the punch 21 out of the hollow cylindrical body 4A. In the impact pressing, the metal block 30 pressed by the punch 21 is stretched into a cylindrical shape so as to surround the punch 21, and the hollow cylindrical body 4A is thereby formed. Therefore, a surface of the metal block 30 (particularly, its bottom surface when the metal block 30 is placed in the circular hole 24) becomes the outer circumferential surface of the hollow cylindrical body 4A.

The material, shape, size, etc. of the metal block 30 may be selected according to the material, shape, size, etc. of the conductive support to be manufactured. The metal block 30 may be made of pure aluminum or an aluminum alloy because of their good workability. From the viewpoint of workability, the content (percent by weight) of aluminum in the metal block 30 is preferably 90.0% or more, more preferably 95.0% or more, and still more preferably 99.0% or more.

The thickness of the hollow cylindrical body 4A is selected according to the inner diameter, outer diameter, and wall thickness of the conductive support to be manufactured, the number of times of ironing described later, etc.

Before ironing, the hollow cylindrical body 4A may be subjected to annealing.

—Ironing—

Figure 3B:
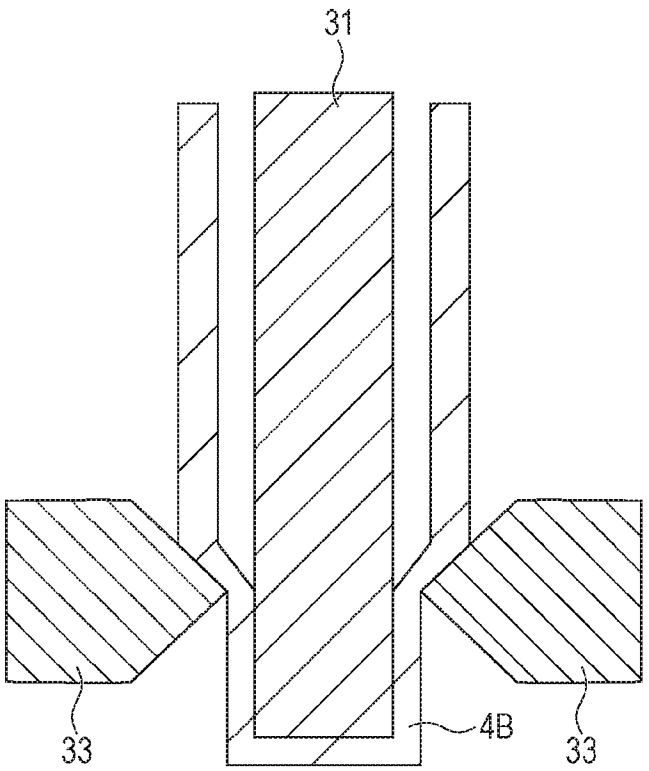
FIGS. 3A and 3B are schematic diagrams showing an example of ironing for forming the conductive support.
Figure 3A:
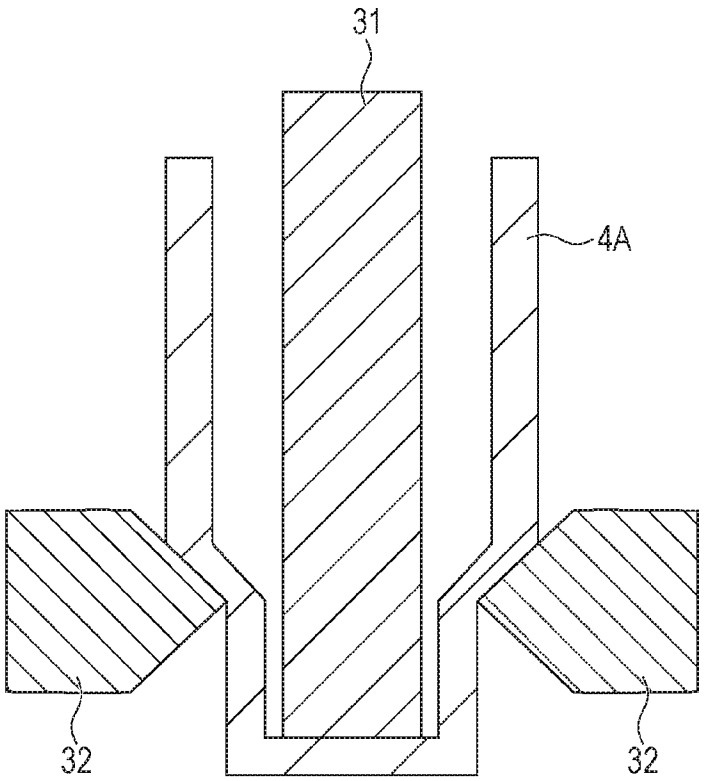

FIGS. 3A and 3B show an example of the process of subjecting the hollow cylindrical body to ironing. In the example shown, the hollow cylindrical body is subjected to drawing shown in FIG. 3A and then subjected to ironing shown in FIG. 3B.

As shown in FIG. 3A, a cylindrical punch 31 is inserted into the hollow cylindrical body 4A, and the punch 31, together with the hollow cylindrical body 4A, is pressed into a die 32 having a smaller diameter than the hollow cylindrical body 4A to thereby reduce the diameter of the hollow cylindrical body 4A. Next, as shown in FIG. 3B, the punch 31, together with the hollow cylindrical body 4A, is pressed into a die 33 having a smaller diameter than the die 32 to obtain a hollow cylindrical body 4B having a smaller wall thickness than the hollow cylindrical body 4A. The hollow cylindrical body 4A may be subjected to ironing without drawing, and the ironing may be performed in plural separate steps.

The ironing rate in one ironing pass {(wall thickness before ironing−wall thickness after ironing)/(wall thickness before ironing)×100} is preferably from 5% to 40% inclusive, more preferably from 10% to 30% inclusive, and still more preferably from 15% to 25% inclusive.

—Shot Peening—

Figure 4:
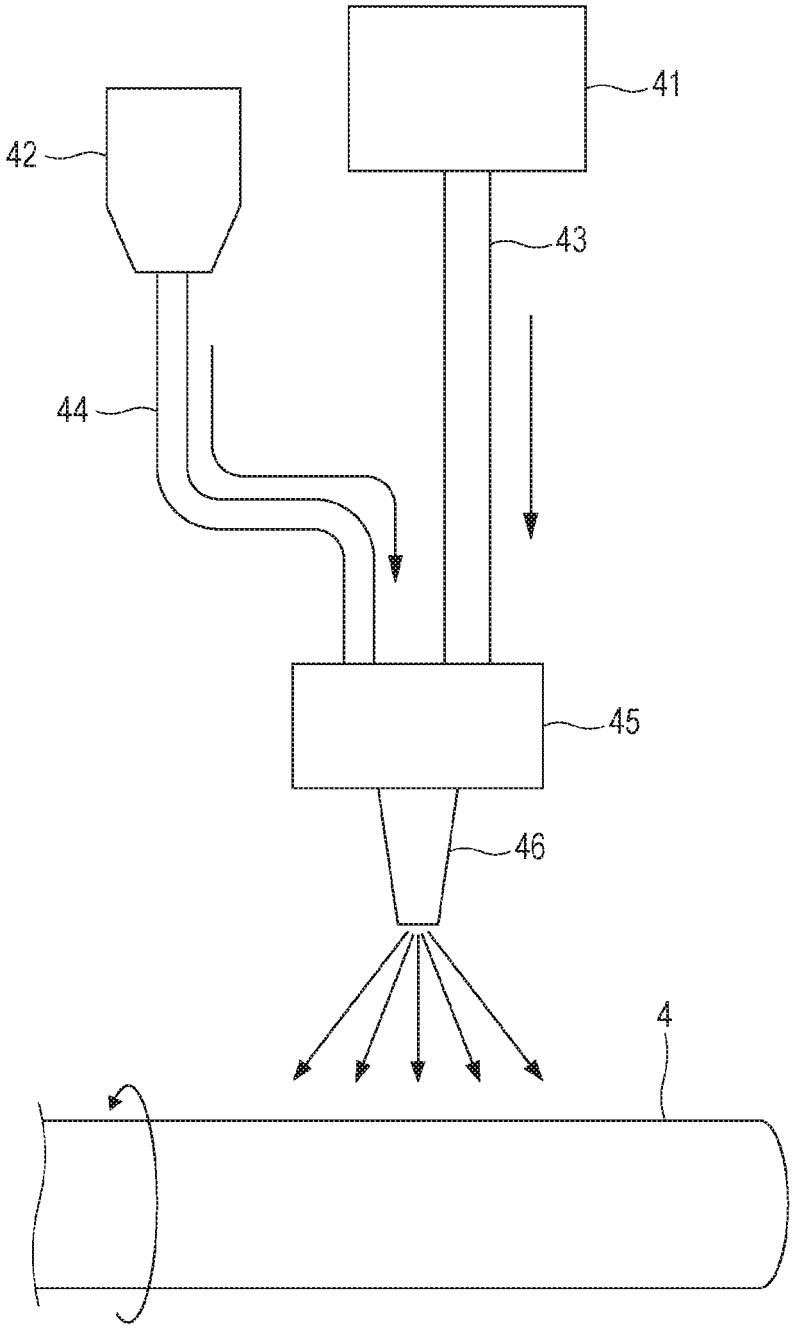
FIG. 4 is a schematic diagram showing an example of shot peening performed on the conductive support.

FIG. 4 shows an example of the process of subjecting the conductive support to shot peening. As shown in FIG. 4, shots (not shown) stored in a tank 42 are supplied to a mixing unit 45 through a supply tube 44, and the shots and compressed air supplied from a compressor 41 through a supply tube 43 are mixed in the mixing unit 45. Next, the shots are injected with the compressed air through a nozzle 46 and strike the conductive support 4 rotated by a driving unit (not shown). In the conductive support 4, its metal surface struck by the shots is modified.

No particular limitation is imposed on the shots, and examples of the shots include: metal particles such as stainless steel, iron, and zinc particles; ceramic particles such as zirconia, alumina, silica, and silicon carbide particles; resin particles such as polyamide and polycarbonate particles; and glass particles.

The surface residual stress of a metal tends to decrease as projection pressure during shot peening increases and as projection time increases. The projection time may be controlled according to the projection pressure. When the projection pressure is relatively low, the projection time is increased accordingly to thereby control the surface residual stress to about −10 MPa or less.

From the viewpoint that the surface residual stress of the outer circumferential surface of the conductive support is controlled to about −10 MPa or less, the particle diameter and projection pressure of the shots used for shot peening may be within the following ranges. The projection pressure is the pressure used to push the shots out of the apparatus.

Particle diameter of shots: preferably from 30 μm to 300 μm inclusive and more preferably from 60 μm to 250 μm inclusive Projection pressure of shots: preferably from 0.1 MPa to 0.5 MPa inclusive and more preferably from 0.15 MPa to 0.4 MPa inclusive An example of a method for manufacturing the conductive support according to the present exemplary embodiment is the following manufacturing method. Preferred conditions in the following manufacturing method are as described above.

The manufacturing method includes:

an impact pressing step of pressing a metal block disposed in a female die using a cylindrical male die to plastically deform the metal block such that the metal block conforms to the outer circumferential surface of the male die to thereby form a hollow cylindrical body;

an ironing step of causing the hollow cylindrical body to pass through an annular pressing die having an inner diameter smaller than the outer diameter of the hollow cylindrical body to thereby reduce the wall thickness of the hollow cylindrical body; and a shot peening step of causing shots to strike at least part of the outer circumferential surface of the hollow cylindrical body subjected to the ironing step to thereby control the surface residual stress of the area struck by the shots to about −10 MPa or less.

After the shot peening, the surface of the conductive support may be subjected to treatment such as anodic oxidation, pickling, or boehmite treatment.

Next, an electrophotographic photoreceptor according to an exemplary embodiment will be described.

<Electrophotographic Photoreceptor>

The photoreceptor according to the present exemplary embodiment includes the conductive support according to the preceding exemplary embodiment and a photosensitive layer disposed on the conductive support.

Specifically, the photoreceptor according to the present exemplary embodiment includes the conductive support including the metallic cylindrical member and the photosensitive layer disposed on the conductive support. The outer circumferential surface of at least part of a bare area of the conductive support has a surface residual stress of about −10 MPa or less. The "bare area" of the conductive support is an area on which no photosensitive layer and no other layers are disposed.

Figure 5:
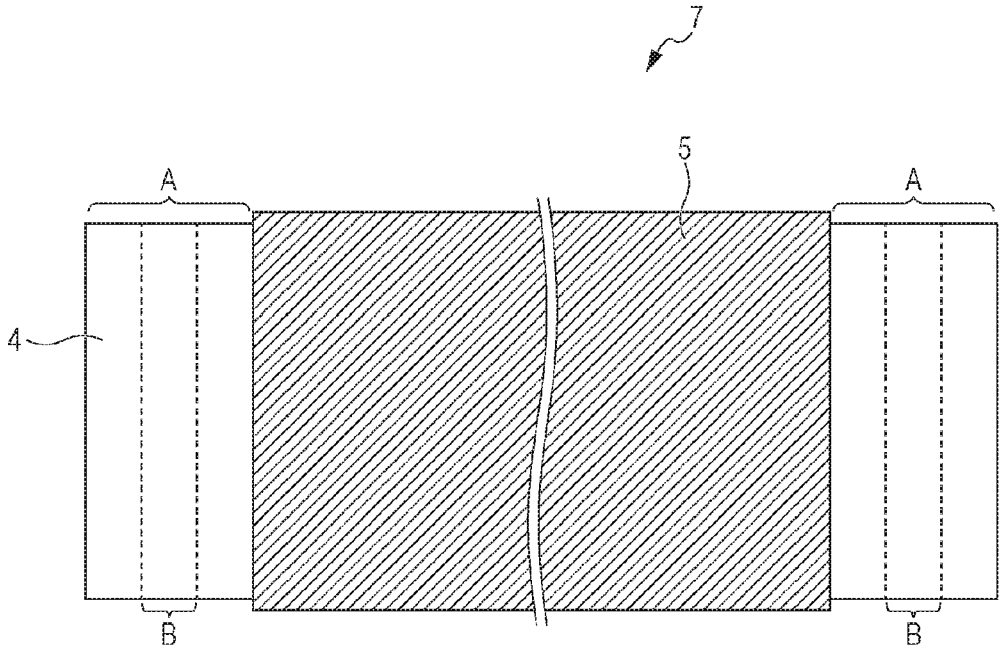
FIG. 5 is a schematic configuration diagram showing an example of an electrophotographic photoreceptor according to an exemplary embodiment.

FIG. 5 is a schematic configuration diagram showing an example of the photoreceptor according to the present exemplary embodiment. The photoreceptor 7 shown in FIG. 5 includes a conductive support 4, which is a metallic cylindrical member, and a photosensitive layer 5 disposed on the conductive support 4. The conductive support 4 may be a hollow cylindrical member or may be a solid cylindrical member. An undercoat layer may be disposed below the photosensitive layer 5, and a protective layer may be disposed on the photosensitive layer 5.

In the photoreceptor 7 shown in FIG. 5, an area A is present in each of opposite longitudinal end portions of the conductive support 4. In each area A, no photosensitive layer 5 and no other layers are disposed, and the outer circumferential surface of the conductive support 4 is exposed. At least part of each area A is an area B in which the surface residual stress of the outer circumferential surface is about −10 MPa or less. When the photoreceptor 7 is attached to an image forming apparatus or a process cartridge, contact members included in the image forming apparatus are in contact with the areas B of the photoreceptor 7.

In the photoreceptor 7 shown in FIG. 5, each area B in at least part of the corresponding area A extends over the entire circumference. The areas B are not limited to the example shown in FIG. 5, may be disposed intermittently in the circumferential direction, or may extend over the entire areas A.

Figure 6:
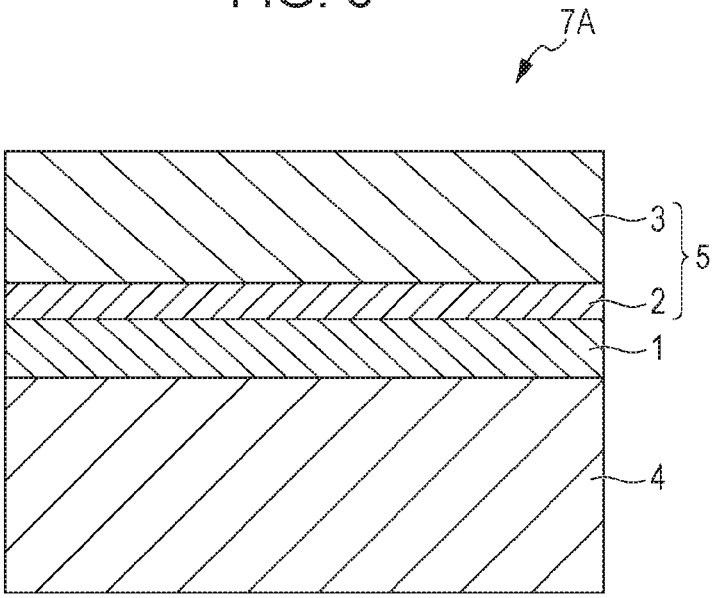
FIG. 6 is a schematic partial cross-sectional view showing an example of the layer structure of the electrophotographic photoreceptor according to the exemplary embodiment.

FIG. 6 is a schematic partial cross-sectional view showing an example of the layer structure of the photoreceptor 7. A photoreceptor 7A shown in FIG. 6 has a structure in which an undercoat layer 1, a charge generation layer 2, and a charge transport layer 3 are stacked in this order on a conductive support 4. The charge generation layer 2 and the charge transport layer 3 form a photosensitive layer 5.

The photoreceptor 7 may be of a function-separated type in which the charge generation layer 2 is separated from the charge transport layer 3 as shown in FIG. 6 or may be a single layer-type photosensitive layer in which the charge generation layer 2 is integrated with the charge transport layer 3. The photoreceptor 7 may have a layer structure with no undercoat layer 1. The photoreceptor 7 may have a layer structure in which a protective layer is further disposed on the photosensitive layer 5.

Each of the layers of the photoreceptor will next be described. In the following description, the reference numerals will be omitted.

[Undercoat Layer]

The undercoat layer is a layer containing, for example, inorganic particles and a binder resin.

Examples of the inorganic particles include inorganic particles having a powder resistivity (volume resistivity) of from $10^2$ Ωcm to $10^{11}$ Ωcm inclusive. The inorganic particles having the resistance value described above may be, for example, metal oxide particles such as tin oxide particles, titanium oxide particles, zinc oxide particles, or zirconium oxide particles and are particularly preferably zinc oxide particles.

The specific surface area of the inorganic particles may be, for example, 10 $m^2/g$ or more as measured by the BET method.

The volume average diameter of the inorganic particles is, for example, from 50 nm to 2,000 nm inclusive (preferably from 60 nm to 1,000 nm inclusive).

The amount of the inorganic particles with respect to the binder resin is, for example, preferably from 10% by weight to 80% by weight inclusive and more preferably from 40% by weight to 80% by weight inclusive.

The inorganic particles may be subjected to surface treatment. The inorganic particles used may be a mixture of at least two types of inorganic particles subjected to different types of surface treatment or having different diameters.

Examples of the surface treatment agent include silane coupling agents, titanate-based coupling agents, aluminum-based coupling agents, and surfactants. In particular, silane coupling agents are preferred, and silane coupling agents having an amino group are more preferred.

Examples of the silane coupling agents having an amino group include, but not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

A mixture of two or more silane coupling agents may be used. For example, a silane coupling agent having an amino group may be used in combination with an additional silane coupling agent. Examples of the additional silane coupling agent include, but not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using the surface treatment agent may be any known method and may be a dry process or a wet process.

The amount of the surface treatment agent used with respect to the inorganic particles may be, for example, from 0.5% by weight to 10% by weight inclusive.

To improve carrier blocking ability and long-term stability of electric characteristics, the undercoat layer may contain, in addition to the inorganic particles, an electron-accepting compound (acceptor compound).

Examples of the electron-accepting compound include electron transport materials such as: quinone-based compounds such as chloranil and bromanil; tetracyanoquinodimethane-based compounds; fluorenone compounds such as 2,4,7-trinitrofluorenone and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone-based compounds; thiophene compounds; and diphenoquinone compounds such as 3,3',5,5'-tetra-t-butyldiphenoquinone. The electron-accepting compound is preferably a compound having an anthraquinone structure. The compound having the anthraquinone structure is preferably, for example, a hydroxyanthraquinone compound, an aminoanthraquinone compound, or an aminohydroxyanthraquinone compound. More specifically, the compound having the anthraquinone structure is preferably, for example, anthraquinone, alizarin, quinizarin, anthrarufin, or purpurin.

The electron-accepting compound may be dispersed in the undercoat layer together with the inorganic particles, or the electron-accepting compound adhering to the surface of the inorganic particles may be contained in the undercoat layer.

A dry process or a wet process may be used to cause the electron-accepting compound to adhere to the surface of the inorganic particles.

In the dry process, for example, while the inorganic particles are stirred using, for example, a mixer with large shear force, the electron-accepting compound alone or the electron-accepting compound dissolved in an organic solvent is added dropwise or sprayed with dry air or nitrogen gas to thereby cause the electron-accepting compound to adhere to the surface of the inorganic particles. The electron-accepting compound may be added dropwise or sprayed at a temperature equal to or lower than the boiling point of the solvent. After the electron-accepting compound is added dropwise or sprayed, baking may be performed at 100° C. or higher. No particular limitation is imposed on the temperature and time of the baking, so long as electrophotographic characteristics are obtained.

In the wet process, for example, while the inorganic particles are dispersed in a solvent by means of stirring, ultrasonic waves, a sand mill, an attritor, a ball mill, etc., the electron-accepting compound is added. Then the mixture is stirred or dispersed, and the solvent is removed, whereby the electron-accepting compound is caused to adhere to the surface of the inorganic particles. The solvent is removed by, for example, filtration or distillation. After the removal of the solvent, baking may be performed at 100° C. or higher. No particular limitation is imposed on the temperature and time of the baking, so long as electrophotographic characteristics are obtained. In the wet process, water contained in the inorganic particles may be removed before the electron-accepting compound is added. Examples of the method for removing water include a water removal method in which the inorganic particles are heated in the solvent under stirring and a method in which the water is removed by forming an azeotrope with the solvent.

The electron-accepting compound may be caused to adhere to the inorganic particles before, after, or simultaneously with the surface treatment of the inorganic particles with the surface treatment agent.

The amount of the electron-accepting compound with respect to the inorganic particles is, for example, from 0.01% by weight to 20% by weight inclusive and preferably from 0.01% by weight to 10% by weight inclusive.

Examples of the binder resin used for the undercoat layer include known materials such as: known macromolecular compounds such as acetal resins (e.g., polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used for the undercoat layer include charge transport resins having a charge transport group and conductive resins (e.g., polyaniline).

The binder resin used for the undercoat layer may be a resin insoluble in a solvent used for application of an upper layer disposed on the undercoat layer. In particular, the binder resin may be: a thermosetting resin such as a urea resin, a phenolic resin, a phenol-formaldehyde resin, a melamine resin, a urethane resin, an unsaturated polyester resin, an alkyd resin, or an epoxy resin; or a resin obtained by reacting a curing agent with at least one selected from the group consisting of polyamide resins, polyester resins, polyether resins, methacrylic resins, acrylic resins, polyvinyl alcohol resins, and polyvinyl acetal resins.

When a combination of two or more binder resins is used, the mixing ratio of the resins is set as needed.

The undercoat layer may contain various additives for the purpose of improving electric characteristics, environmental stability, and image quality.

Examples of the additives include known materials such as: electron transport pigments such as polycyclic condensed pigments and azo-based pigments; zirconium chelate compounds; titanium chelate compounds; aluminum chelate compounds; titanium alkoxide compounds; organic titanium compounds; and silane coupling agent. As described above, a silane coupling agent is used for the surface treatment of the inorganic particles and may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethyl acetoacetate aluminum diisopropylate, and aluminum tris(ethyl acetoacetate).

These additives may be used alone or as a mixture or polycondensation product of plural compounds.

The Vickers hardness of the undercoat layer may be 35 or more.

The surface roughness (ten-point average roughness) of the undercoat layer may be adjusted to from 1/(4n) (n: refractive index of the upper layer) to ½ of the wavelength λ of a laser used for exposure, in order to suppress moire images.

To adjust the surface roughness, resin particles, for example, may be added to the undercoat layer. Examples of the resin particles include silicone resin particles and cross-linked polymethyl methacrylate resin particles. To adjust the surface roughness, the surface of the undercoat layer may be polished. Examples of the method for polishing include buffing, sandblasting, wet honing, and grinding.

No particular limitation is imposed on the method of forming the undercoat layer, and any known formation method may be used. For example, a coating solution for forming the undercoat layer is prepared by adding the above-described components to a solvent, and a coating of the coating solution is formed, dried, and then heated as needed.

Examples of the solvent for preparing the coating solution for forming the undercoat layer include known organic solvents such as alcohol-based solvents, aromatic hydrocarbon solvents, halogenated hydrocarbon solvents, ketone-based solvents, ketone alcohol-based solvents, ether-based solvents, and ester-based solvents.

Specific examples of the solvent include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing the inorganic particles to prepare the coating solution for forming the undercoat layer include known methods using a roll mill, a ball mill, a vibratory ball mill, an attritor, a sand mill, a colloid mill, and a paint shaker.

Examples of the method for applying the coating solution for forming the undercoat layer to the conductive support include ordinary methods such as a blade coating method, a wire bar coating method, a spray coating method, a dip coating method, a bead coating method, an air knife coating method, and a curtain coating method.

The thickness of the undercoat layer is, for example, preferably 15 μm or more and more preferably within the range of from 20 μm to 50 μm inclusive.

[Intermediate Layer]

Although not illustrated, an intermediate layer may be disposed between the undercoat layer and the photosensitive layer.

The intermediate layer is, for example, a layer containing a resin. Examples of the resin used for the intermediate layer include macromolecular compounds such as acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organometallic compound. Examples of the organometallic compound used for the intermediate layer include organometallic compounds containing metal atoms such as zirconium, titanium, aluminum, manganese, and silicon atoms.

These compounds for the intermediate layer may be used alone or as a mixture or polycondensation product of plural compounds.

The intermediate layer may be a layer containing an organometallic compound containing a zirconium atom or a silicon atom.

No particular limitation is imposed on the method for forming the intermediate layer, and any known formation method may be used. For example, a coating solution for forming the intermediate layer is prepared by adding the above-described components to a solvent, and a coating of the coating solution is formed, dried, and then heated as needed.

The coating method used for forming the intermediate layer may be any ordinary method such as a dip coating method, a push-up coating method, a wire bar coating method, a spray coating method, a blade coating method, a knife coating method, or a curtain coating method.

The thickness of the intermediate layer is set within the range of, for example, from 0.1 μm to 3 μm inclusive. The intermediate layer may be used as the undercoat layer.

[Charge Generation Layer]

The charge generation layer is, for example, a layer containing a charge generation material and a binder resin. The charge generation layer may be a vapor-deposited layer of the charge generation material. The vapor-deposited layer of the charge generation material is suitable when an incoherent light source such as an LED (Light Emitting Diode) or an organic EL (Electro-Luminescence) image array is used.

Examples of the charge generation material include: azo pigments such as bisazo pigments and trisazo pigments; condensed aromatic pigments such as dibromoanthanthrone; perylene pigments; pyrrolopyrrole pigments; phthalocyanine pigments; zinc oxides; and trigonal selenium.

Of these, metal phthalocyanine pigments and metal-free phthalocyanine pigments are preferably used as the charge generation material for exposure to near-infrared laser light. More preferred examples of the charge generation material include hydroxygallium phthalocyanine, chlorogallium phthalocyanine, dichlorotin phthalocyanine, and titanyl phthalocyanine.

For exposure to near-ultraviolet laser light, the charge generation material may be any of: condensed aromatic pigments such as dibromoanthanthrone; thioindigo-based pigments; porphyrazine compounds; zinc oxides; trigonal selenium; bisazo pigments; etc.

When an incoherent light source, such as an LED or an organic EL image array, having a light-emission center wavelength of from 450 nm to 780 nm inclusive is used, any of the above-described charge generation materials may be used. When the photosensitive layer used is a thin film with a thickness of 20 μm or less from the viewpoint of resolution, the strength of electric field in the photosensitive layer is high, and a reduction in the amount of charge due to charge injection from the conductive support, i.e., image defects called black spots, is likely to occur. This is significant when the charge generation material used is a p-type semiconductor, such as trigonal selenium or a phthalocyanine pigment, which is likely to generate a dark current.

However, when the charge generation material used is an n-type semiconductor such as a condensed aromatic pigment, a perylene pigment, or an azo pigment, a dark current is less likely to occur, so that the occurrence of the image defects called black spots may be suppressed.

The type of a charge generation material is determined by a commonly used time-of-flight method. The type is determined by the polarity of photocurrent, and a charge generation material that allows electrons to flow as a carrier more easily than holes is judged as an n-type charge generation material.

The binder resin used for the charge generation layer may be selected from a wide variety of insulating resins or may be selected from organic photoconductive polymers such as poly-N-vinylcarbazole, polyvinylanthracene, polyvinylpyrene, and polysilanes.

Examples of the binder resin include polyvinyl butyral resins, polyarylate resins (such as polycondensation products of bisphenols and aromatic dicarboxylic acids), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinylpyrrolidone resins. The term "insulating" as used herein means that the volume resistivity is $10^{13}$ Ωcm or more. One of these binder resins may be used alone, or a mixture of two or more may be used.

The mixing weight ratio of the charge generation material to the binder resin may be within the range of from 10:1 to 1:10.

The charge generation layer may further contain any known additive.

No particular limitation is imposed on the method for forming the charge generation layer, and any known method may be used. For example, a coating solution for forming the charge generation layer is prepared by adding the above-described components to a solvent, and a coating of the coating solution is formed, dried, and then heated as needed. The charge generation layer may be formed by vapor deposition of the charge generation material. The formation of the charge generation layer by vapor deposition is particularly suitable when the charge generation material used is a condensed aromatic pigment or a perylene pigment.

Examples of the solvent for preparing the coating solution for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. One of these solvents may be used alone, or a mixture of two or more may be used.

Examples of the method for dispersing particles (e.g., the charge generation material) in the coating solution for forming the charge generation layer include: methods using media dispersers such as a ball mill, a vibratory ball mill, an attritor, a sand mill, and a horizontal sand mill; stirring; and methods using media-less dispersers such as an ultrasonic wave disperser, a roll mill, and a high-pressure homogenizer. Examples of the high-pressure homogenizer include: a collision-type homogenizer in which the dispersion is subjected to liquid-liquid collision or liquid-wall collision under high pressure to thereby disperse the particles; and a passing-through-type homogenizer in which the dispersion is caused to pass through fine flow paths under high pressure to thereby disperse the particles. To disperse the particles, it is effective that the average particle diameter of the charge generation material in the coating solution for forming the charge generation layer is 0.5 μm or less, preferably 0.3 μm or less, and more preferably 0.15 μm or less.

Examples of the method for applying the coating solution for forming the charge generation layer to the undercoat layer (or intermediate layer) include ordinary methods such as a blade coating method, a wire bar coating method, a spray coating method, a dip coating method, a bead coating method, an air knife coating method, and a curtain coating method.

The thickness of the charge generation layer is set, for example, within the range of preferably from 0.1 μm to 5.0 μm inclusive and more preferably from 0.2 μm to 2.0 μm inclusive.

[Charge Transport Layer]

The charge transport layer is, for example, a layer containing a charge transport material and a binder resin. The charge transport layer may be a layer containing a macromolecular charge transport material.

Examples of the charge transport material include electron transport compounds such as: quinone-based compounds such as p-benzoquinone, chloranil, bromanil, and anthraquinone; tetracyanoquinodimethane-based compounds; fluorenone compounds such as 2,4,7-trinitrofluorenone; xanthone-based compounds; benzophenone-based compounds; cyanovinyl-based compounds; and ethylene-based compounds. Other examples of the charge transport material include hole transport compounds such as triarylamine-based compounds, benzidine-based compounds, arylalkane-based compounds, aryl-substituted ethylene-based compounds, stilbene-based compounds, anthracene-based compounds, and hydrazone-based compounds. One of these charge transport materials may be used alone, or two or more of them may be used, but this is not a limitation.

From the viewpoint of charge mobility, the charge transport material may be a triarylamine derivative represented by the following structural formula (a-1) or a benzidine derivative represented by the following structural formula (a-2).

(a-1)

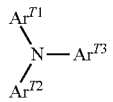

In structural formula (a-1), $Ar^{T1}$, $Ar^{T2}$, and $Ar^{T3}$ are each independently a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ are each independently a hydrogen atom, a substituted or unsubstituted alkyl group, or a substituted or unsubstituted aryl group. Examples of the substituents in the above groups include halogen atoms, alkyl groups having from 1 to 5 carbon atoms, alkoxy groups having from 1 to 5 carbon atoms, and amino groups substituted with alkyl groups having from 1 to 3 carbon atoms.

(a-2)

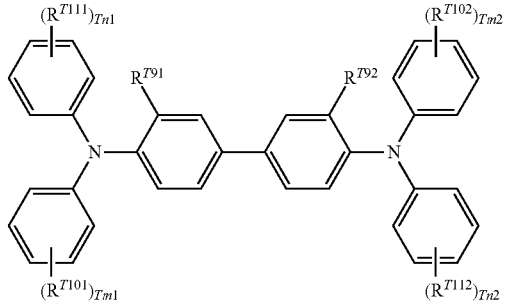

In structural formula (a-2), $R^{T91}$ and $R^{T92}$ are each independently a hydrogen atom, a halogen atom, an alkyl group having from 1 to 5 carbon atoms, or an alkoxy group having from 1 to 5 carbon atoms. $R^{T101}$, $R^{T102}$, $R^{T111}$, and $R^{T112}$ are each independently a halogen atom, an alkyl group having from 1 to 5 carbon atoms, an alkoxy group having from 1 to 5 carbon atoms, an amino group substituted with an alkyl group having 1 to 2 carbon atoms, a substituted or unsubstituted aryl group, $—C(R^{T12})=C(R^{T13})(R^{T14})$, or $—CH=CH—CH=C(R^{T15})(R^{T16})$. $R^{T12}$, $R^{T13}$, $R^{T14}$, $R^{T15}$, and $R^{T16}$ are each independently a hydrogen atom, a substituted or unsubstituted alkyl group, or a substituted or unsubstituted aryl group. Tm1, Tm2, Tn1, and Tn2 are each independently an integer from 0 to 2. Examples of the substituents in the above groups include halogen atoms, alkyl groups having from 1 to 5 carbon atoms, alkoxy groups having from 1 to 5 carbon atoms, and amino groups substituted with alkyl groups having from 1 to 3 carbon atoms.

Among the triarylamine derivatives represented by structural formula (a-1) and the benzidine derivatives represented by structural formula (a-2), a triarylamine derivative having "$—C_6H_4—CH=CH—CH=C(R^{T7})(R^{T8})$" and a benzidine derivative having "$—CH=CH—CH=C(R^{T15})(R^{T16})$" may be selected from the viewpoint of charge mobility.

The macromolecular charge transport material used may be any known charge transport material such as poly-N-vinylcarbazole or polysilane. Specifically, polyester-based macromolecular charge transport materials may be used. The macromolecular charge transport material may be used alone or in combination with a binder resin.

Examples of the binder resin used for the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilanes. Of these, polycarbonate resins and polyarylate resins may be suitably used as the binder resin. These binder resins may be used alone, or two or more types may be used.

The mixing weight ratio of the charge transport material to the binder resin may be from 10:1 to 1:5.

The charge transport layer may further contain any known additive.

No particular limitation is imposed on the method for forming of the charge transport layer, and any known formation method may be used. For example, a coating solution for forming the charge transport layer is prepared by adding the above-described components to a solvent, and a coating of the coating solution is formed, dried, and then heated as needed.

Examples of the solvent for preparing the coating solution for forming the charge transport layer include ordinary organic solvents such as: aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and linear ethers such as tetrahydrofuran and ethyl ether. These solvents are used alone or as a mixture of two or more.

Examples of the application method for applying the coating solution for forming the charge transport layer to the charge generation layer include ordinary methods such as a blade coating method, a wire bar coating method, a spray coating method, a dip coating method, a bead coating method, an air knife coating method, and a curtain coating method.

The thickness of the charge transport layer is set, for example, within the range of preferably from 5 μm to 50 μm inclusive and more preferably from 10 μm to 30 μm inclusive.

[Protective Layer]

The protective layer is disposed on the photosensitive layer as needed. The protective layer is disposed for the purpose of, for example, preventing chemical changes of the photosensitive layer in a charged state and further improving the mechanical strength of the photosensitive layer.

Therefore, the protective layer may be a layer formed from a cured film (cross-linked film). Examples of this layer include layers shown in 1) and 2 below.

1) A layer formed from a cured film of a composition containing a reactive group-containing charge transport material having, in its molecule, a reactive group and a charge transport skeleton (i.e., a layer containing a polymerized or cross-linked product of the reactive group-containing charge transport material).

2) A layer formed from a cured film of a composition containing a non-reactive charge transport material and a reactive group-containing non-charge transport material having no charge transport skeleton and having a reactive group (i.e., a layer containing a polymerized or cross-linked product of the non-reactive charge transport material and the reactive group-containing non-charge transport material).

Examples of the reactive group in the reactive group-containing charge transport material include known reactive groups such as chain polymerizable groups, an epoxy group, —OH, —OR [R is an alkyl group], —$NH_2$, —SH, —COOH, and —$SiR^{Q1}{}_{3-Qn}(OR^{Q2})_{Qn}$ [$R^{Q1}$ is a hydrogen atom, an alkyl group, or a substituted or unsubstituted aryl group, $R^{Q2}$ is a hydrogen atom, an alkyl group, or a trialkylsilyl group, and Qn is an integer from 1 to 3].

No particular limitation is imposed on the chain polymerizable group, so long as it is a radical polymerizable functional groups. For example, the chain polymerizable group is a functional group having a group including at least a carbon-carbon double bond. Specific examples of the chain polymerizable group include groups including at least one selected from a vinyl group, a vinyl ether group, a vinyl thioether group, a styryl group (phenyl vinyl group), an acryloyl group, a methacryloyl group, and derivatives thereof. In particular, because of its high reactivity, a group including at least one selected from a vinyl group, a styryl group (phenyl vinyl group), an acryloyl group, a methacryloyl group, and derivatives thereof may be used as the chain polymerizable group.

No particular limitation is imposed on the charge transport skeleton of the reactive group-containing charge transport material, so long as the skeleton is a structure well-known in the technical field of photoreceptors. Examples of the charge transport skeleton include skeletons originating from nitrogen-containing hole transport compounds such as triarylamine-based compounds, benzidine-based compounds, and hydrazone-based compounds and having a structure conjugated with a nitrogen atom. Of these, a triarylamine skeleton may be selected.

The reactive group-containing charge transport material having the reactive group and the charge transport skeleton, the non-reactive charge transport material, and the reactive group-containing non-charge transport material may be selected from known materials.

The protective layer may further contain any known additive.

No particular limitation is imposed on the method for forming the protective layer, and any known formation method may be used. For example, a coating solution for forming the protective layer is prepared by adding the above-described components to a solvent, and a coating of the coating solution is formed, dried, and then heated as needed.

Examples of the solvent for preparing the coating solution for forming the protective layer include: aromatic-based solvents such as toluene and xylene; ketone-based solvents such as methyl ethyl ketone, methyl isobutyl ketone, and cyclohexanone; ester-based solvents such as ethyl acetate and butyl acetate; ether-based solvents such as tetrahydrofuran and dioxane; cellosolve-based solvents such as ethylene glycol monomethyl ether; and alcohol-based solvents such as isopropyl alcohol and butanol. These solvents are used alone or as a mixture of two or more. The coating solution for forming the protective layer may be a solvent-free coating solution.

Examples of the method for applying the coating solution for forming the protective layer to the photosensitive layer (e.g., the charge transport layer) include ordinary methods such as a dip coating method, a push-up coating method, a wire bar coating method, a spray coating method, a blade coating method, a knife coating method, and a curtain coating method.

The thickness of the protective layer is set, for example, within the range of preferably from 1 μm to 20 μm inclusive and more preferably from 2 μm to 10 μm inclusive.

[Single-Layer Type Photosensitive Layer]

The single-layer type photosensitive layer (charge generation/charge transport layer) is a layer including, for example, a charge generation material, a charge transport material, and, if necessary, a binder resin and other known additives. These materials are the same as those described for the charge generation layer and the charge transport layer.

In the single-layer type photosensitive layer, the content of the charge generation material with respect to the total solid content may be from 10% by weight to 85% by weight inclusive and is preferably from 20% by weight to 50% by weight inclusive. In the single-layer type photosensitive layer, the content of the charge transport material with respect to the total solid content may be from 5% by weight to 50% by weight inclusive.

A method for forming the single-layer type photosensitive layer is the same as the method for forming the charge generation layer and the charge transport layer.

The thickness of the single-layer type photosensitive layer may be, for example, from 5 μm to 50 μm inclusive and is preferably from 10 μm to 40 μm inclusive.

<Image Forming Apparatus and Process Cartridge>

An image forming apparatus according to an exemplary embodiment includes: a photoreceptor; a charging unit that charges the surface of the photoreceptor; an electrostatic latent image forming unit that forms an electrostatic latent image on the surface of the charged photoreceptor; a developing unit that develops the electrostatic latent image formed on the surface of the photoreceptor using a developer containing toner to thereby form a toner image; and a transfer unit that transfers the toner image onto the surface of a recording medium. The photoreceptor used is the photoreceptor according to the preceding exemplary embodiment.

The image forming apparatus according to the present exemplary embodiment may be applied to any of various known image forming apparatuses such as: an apparatus including a fixing unit that fixes a toner image transferred onto the surface of a recording medium; a direct transfer-type apparatus that transfers a toner image formed on the surface of a photoreceptor directly onto a recording medium; an intermediate transfer-type apparatus that first-transfers a toner image formed on the surface of a photoreceptor onto the surface of an intermediate transfer body and then second-transfers the toner image transferred onto the surface of the intermediate transfer body onto the surface of a recording medium; an apparatus including a cleaning unit that cleans the surface of an uncharged photoreceptor after the transfer of a toner image; an apparatus including an erasing unit that erases electric charge on a photoreceptor by irradiating the surface of the photoreceptor with erasing light after the transfer of a toner image before charging; and an apparatus including a photoreceptor heating member that increases the temperature of the photoreceptor to reduce relative humidity.

With the intermediate transfer-type apparatus, the transfer unit is, for example, configured to include: the intermediate transfer body having a surface onto which a toner image is to be transferred; a first transfer device that first-transfers the toner image formed on the surface of the photoreceptor onto the surface of the intermediate transfer body; and a second transfer device that second-transfers the toner image transferred onto the surface of the intermediate transfer body onto the surface of a recording medium.

The image forming apparatus according to the present exemplary embodiment may be an image forming apparatus of a dry development type or an image forming apparatus of a wet development type (a development type using a liquid developer).

In the image forming apparatus according to the present exemplary embodiment, for example, a section including the photoreceptor may have a cartridge structure (process cartridge) that is detachable from the image forming apparatus. The process cartridge used may be, for example, a process cartridge including the photoreceptor according to the preceding exemplary embodiment. The process cartridge may include, in addition to the photoreceptor, for example, at least one selected from the group consisting of the charging unit, the electrostatic latent image forming unit, the developing unit, and the transfer unit.

An example of the image forming apparatus according to the present exemplary embodiment will be shown below, but the present invention is not limited thereto. Only components shown in FIG. 7 will be described, and the description of other components will be omitted.

Figure 7:
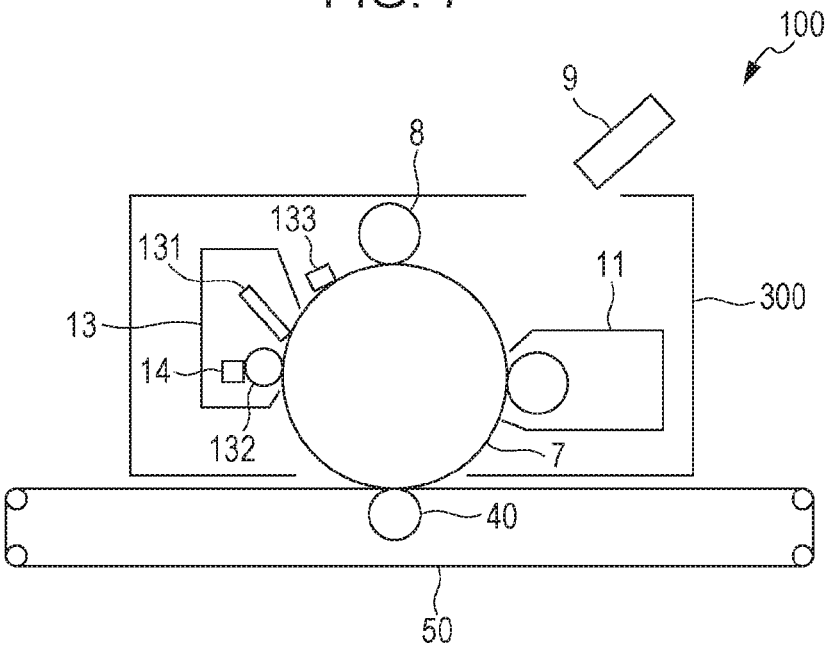
FIG. 7 is a schematic configuration diagram showing an example of an image forming apparatus according to an exemplary embodiment.

FIG. 7 is a schematic configuration diagram showing an example of the image forming apparatus according to the present exemplary embodiment.

As shown in FIG. 7, the image forming apparatus 100 according to the present exemplary embodiment includes: a process cartridge 300 including the photoreceptor 7; an exposure device 9 (an example of the electrostatic latent image forming unit); a transfer device 40 (a first transfer device); and an intermediate transfer body 50. In the image forming apparatus 100, the exposure device 9 is disposed at a position that allows the exposure device 9 to irradiate the photoreceptor 7 with light through an opening of the process cartridge 300. The transfer device 40 is positioned so as to be opposed to the photoreceptor 7 through the intermediate transfer body 50, and the intermediate transfer body 50 is disposed such that a part thereof is in contact with the photoreceptor 7. Although not illustrated, the image forming apparatus 100 further includes a second transfer device that transfers a toner image transferred onto the intermediate transfer body 50 onto a recording medium (e.g., paper). The intermediate transfer body 50, the transfer device 40 (first transfer device), and the second transfer device (not shown) correspond to an example of the above-described transfer unit.

The process cartridge 300 shown in FIG. 7 has a housing that integrally supports the photoreceptor 7, a charging device 8 (an example of the above-described charging unit), a developing device 11 (an example of the above-described developing unit), and a cleaning device 13 (an example of the above-described cleaning unit). The cleaning device 13 includes a cleaning blade (an example of a cleaning member) 131, and the cleaning blade 131 is disposed so as to be in contact with the surface of the photoreceptor 7. The cleaning member may not be embodied as the cleaning blade 131 and may be a conductive or insulating fibrous member. The fibrous member may be used alone or in combination with the cleaning blade 131.

In the example of the image forming apparatus shown in FIG. 7, the image forming apparatus includes a fibrous member 132 (having a roll shape) that supplies a lubricant 14 to the surface of the photoreceptor 7 and a fibrous member 133 (having a flat brush shape) that assists cleaning. However, these components are disposed as needed.

The components of the image forming apparatus according to the present exemplary embodiment will next be described.

[Charging Device]

The charging device 8 used is, for example, a contact-type charging device that uses, for example, a conductive or semi-conductive charging roller, a charging brush, a charging film, a charging rubber blade, or a charging tube. Alternatively, any known charging device such as a non-contact type roller charging device or a scorotron or corotron charging device that use corona discharge may be used.

[Exposure Device]

The exposure device 9 may be, for example, an optical device that includes, for example, a semiconductor laser, an LED light, or a liquid crystal shutter and irradiates the surface of the photoreceptor 7 with light having a prescribed image pattern. The wavelength of the light source is within the spectral sensitivity range of the photoreceptor. A commonly used semiconductor laser has a wavelength in the near-infrared range with an oscillation wavelength of about 780 nm. However, the wavelength is not limited thereto, and a laser having an oscillation wavelength on the order of 600 nm or a blue laser having an oscillation wavelength of from 400 nm to 450 nm inclusive may be used. To form a color image, a surface emitting laser source capable of emitting multiple beams is effective.

[Developing Device]

The developing device 11 may be, for example, a general developing device that performs development using the developer through a contact or non-contact process. No particular limitation is imposed on the developing device 11 so long as it has the above-described function, and a developing device suitable for the intended purpose is selected. Examples of the developing device include known developing devices that have the function of causing a single-component or two-component developer to adhere to the photoreceptor 7 using a brush, a roller, etc. Specifically, a developing device using a developing roller that holds the developer on its surface may be used.

The developer used for the developing device 11 may be a single-component developer containing only toner or a two-component developer containing toner and a carrier. The developer may be magnetic or may be non-magnetic. The developer used may be any known developer.

[Cleaning Device]

The cleaning device 13 used is a cleaning blade-type device including the cleaning blade 131. In addition to the cleaning blade type, a fur brush cleaning type or a cleaning-at-development type may be used.

[Transfer Device]

Examples of the transfer device 40 include known transfer chargers such contact-type transfer chargers that use a belt, a roller, a film, a rubber blade, etc. and scorotron and corotron transfer chargers that use corona discharge.

[Intermediate Transfer Body]

The intermediate transfer body 50 used is a semi-conductive belt-shaped body (intermediate transfer belt) containing, for example, polyimide, polyamide-imide, polycarbonate, polyarylate, polyester, or rubber. The intermediate transfer body may have a drum form other than the belt form.

Figure 8:
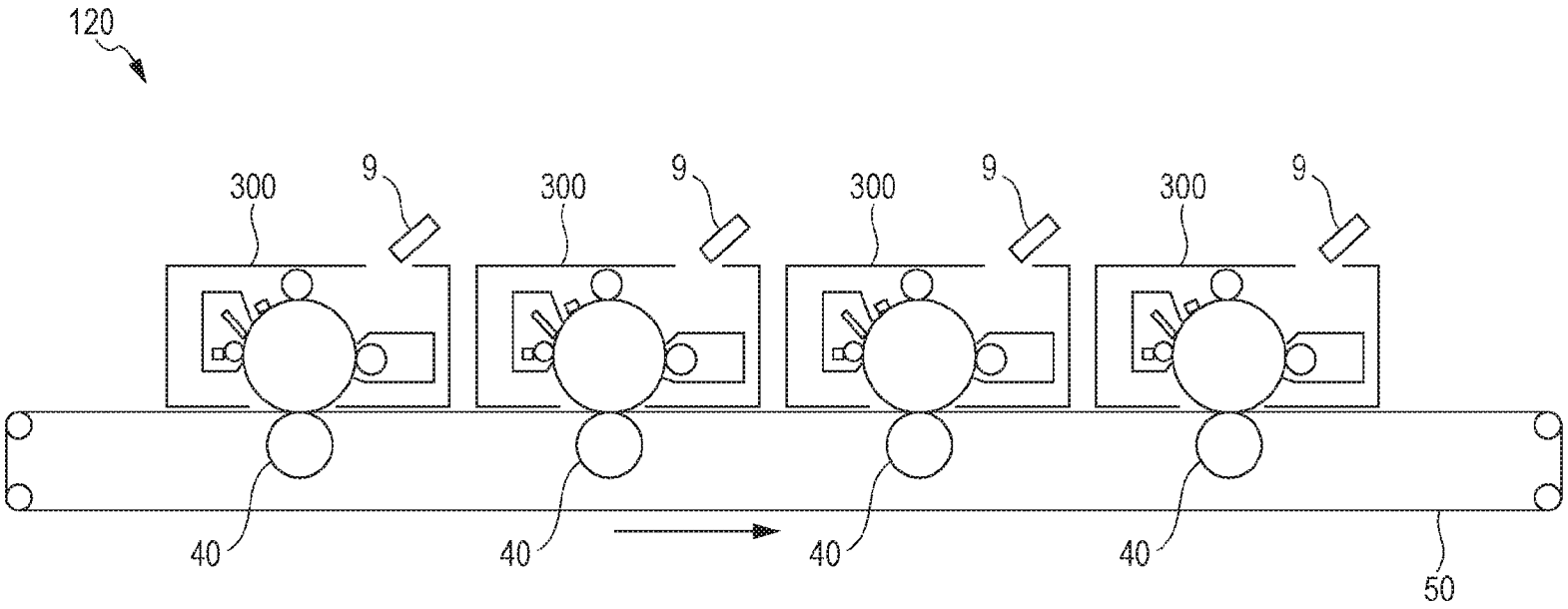
FIG. 8 is a schematic configuration diagram showing an example of an image forming apparatus according to another exemplary embodiment.

FIG. 8 is a schematic configuration diagram showing an example of an image forming apparatus according to another exemplary embodiment.

The image forming apparatus 120 shown in FIG. 8 is a tandem-type multicolor image forming apparatus including four process cartridges 300. In the image forming apparatus 120, the four process cartridges 300 are disposed in series on an intermediate transfer body 50, and one photoreceptor is used for one color. The image forming apparatus 120 has the same structure as the image forming apparatus 100 except that the image forming apparatus 120 is a tandem system.

EXAMPLES

The exemplary embodiments of the invention will be described in detail by way of Examples. However, the exemplary embodiments of the invention are not limited to the Examples.

Example 1

[Production of Conductive Support]

A metal plate having a thickness of 15 mm (aluminum purity: 99.5% or more, JIS name: A1050 alloy) is punched to prepare a metal block having a diameter of 34 mm and a thickness of 15 mm. A lubricant is applied to the surface of the metal block, and then the metal block is subjected to impact pressing to form a cylindrical tube having an outer diameter of 34 mm and a wall thickness of 0.5 mm. Next, the cylindrical tube is subjected to ironing once. Then opposite ends of the resulting cylindrical tube are cut off and subjected to end face treatment to thereby form a cylindrical tube having an outer diameter of 30 mm, a length of 253 mm, and a wall thickness of 0.4 mm.

Next, the entire circumferences of areas extending from positions 5 mm from the opposite ends of the cylindrical tube to positions 15 mm therefrom (10 mm-wide areas) are subjected to shot peening in which zirconia beads having a particle diameter of 60 μm are projected to thereby obtain a conductive support. The shot peening is performed under conditions shown in Table 1 while the cylindrical tube is rotated. The "projection pressure" described in Table 1 is the pressure used to push out the shots, and the "projection time" is the time during which the shots are injected.

[Measurement of Residual Stress]

The residual stress in the areas subjected to shot peening is measured by a $\sin^2 \psi$ method using an X-ray diffraction apparatus (product name: SmartLab, manufactured by Rigaku Corporation). The measurement conditions are as follows. X-ray source: CuKα, tube voltage: 40 kV, tube current: 30 mA, scan axis: θ/2θ, reflection method, ψ angle: 0, −16.71, −23.99, −29.86, −35.09, −40.0 (6 points equally spaced in terms of $\sin^2 \psi$), scan range: 132 to 142 deg, scan mode: continuous, step width: 0.01 deg/step, scan speed: 10.0 deg/min.

The measurement is performed on a central portion of each 10 mmm-wide area of the conductive support onto which the zirconia beads have been projected. Specifically, the measurement is performed at 12 points spaced circumferentially at 30° intervals. The average of the 12 measurements is computed and used as the surface residual stress (MPa).

[Formation of Undercoat Layer]

The materials listed below are mixed and stirred, and the mixture is refluxed for 2 hours. Then toluene is removed under reduced pressure, and the resulting mixture is baked at 135° C. for 2 hours to obtain zinc oxide with its surface modified by a silane coupling agent.

- Zinc oxide (product name: MZ300, manufactured by TAYCA CORPORATION): 100 parts by weight
- Silane coupling agent: 10 wt % solution of N-2-(aminoethyl)-3-aminopropyltriethoxysilane in toluene: 10 parts by weight
- Toluene: 200 parts by weight The materials A listed below are mixed and stirred for 30 minutes. Then the materials B listed below are added and dispersed for 3 hours using a sand mill to obtain a coating solution for forming the undercoat layer. The coating solution for forming the undercoat layer is applied by a dip coating method to the outer circumferential surface of an area of the conductive support that is located inward of the areas subjected to shot peening. Then the coating solution is dried and cured at 180° C. for 30 minutes to thereby form an undercoat layer having a thickness of 30 μm.

—Materials A—

- Surface-modified zinc oxide: 33 parts by weight
- Blocked isocyanate (product name: Sumidur 3175, manufactured by Sumitomo Bayer Urethane Co., Ltd.): 6 parts by weight
- Compound represented by structural formula (AK-1) below: 1 part by weight
- Methyl ethyl ketone: 25 parts by weight —Materials B—

- Butyral resin (product name: S-LEC BM-1, manufactured by SEKISUI CHEMICAL Co., Ltd.): 5 parts by weight
- Silicone resin particles (product name: Tospearl 120, manufactured by Momentive Performance Materials Inc.): 3 parts by weight
- Leveling agent: silicone oil (product name: SH29PA, manufactured by Dow Corning Toray Co., Ltd.): 0.01 parts by weight (AK-1)

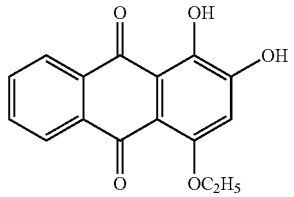

[Formation of Charge Generation Layer]

The materials listed below are placed in a 100-mL glass bottle together with 1.0 mm φ glass beads at a packing fraction of 50% and subjected to dispersion treatment for 2.5 hours using a paint shaker to thereby obtain a coating solution for forming the charge generation layer. The coating solution for forming the charge generation layer is applied to the undercoat layer by dip coating and then dried at 130° C. for 5 minutes to form a charge generation layer having a thickness of 0.20 μm.

Charge generation material: V-type hydroxygallium phthalocyanine having diffraction peaks at Bragg angles (2θ±0.2°) of at least 7.3°, 16.0°, 24.9°, and 28.0° in an X-ray diffraction spectrum using CuKα characteristic X-rays, Maximum peak wavelength in an optical absorption spectrum within the wavelength range of 600 nm to 900 nm: 820 nm, Average particle diameter: 0.12 μm, Maximum particle diameter: 0.2 μm, BET specific surface area: 60 $m^2/g$ Binder resin: vinyl chloride-vinyl acetate copolymer resin (product name: VMCH, manufactured by Nippon Unicar Company Limited)

n-Butyl acetate

The mixing ratio of hydroxygallium phthalocyanine to vinyl chloride-vinyl acetate copolymer resin is 55% by volume: 45% by volume, and the solid content of the coating solution for forming the charge generation layer is 6% by weight. The above volume ratio is computed using the following values. Specific gravity of hydroxygallium phthalocyanine: 1.606 $g/cm^3$. Specific gravity of vinyl chloride-vinyl acetate copolymer resin: 1.35 $g/cm^3$.

[Formation of Charge Transport Layer]

The materials listed below are mixed to obtain a coating solution for forming the charge transport layer. The coating solution for forming the charge transport layer is applied to the charge generation layer by dip coating and then dried at 145° C. for 30 minutes to obtain a charge transport layer having a thickness of 30 μm.

Binder resin: bisphenol Z polycarbonate resin (homopolymer of bisphenol Z, viscosity-average molecular weight: 40,000): 58 parts by weight Butadiene-based charge transport material: compound represented by structural formula (CT1A) below: 8 parts by weight Benzidine-based charge transport material: compound represented by structural formula (CT2A) below: 32 parts by weight Hindered phenol-based antioxidant: compound represented by structural formula (HP-1) below: 2 parts by weight Tetrahydrofuran: 340 parts by weight (CT1A)

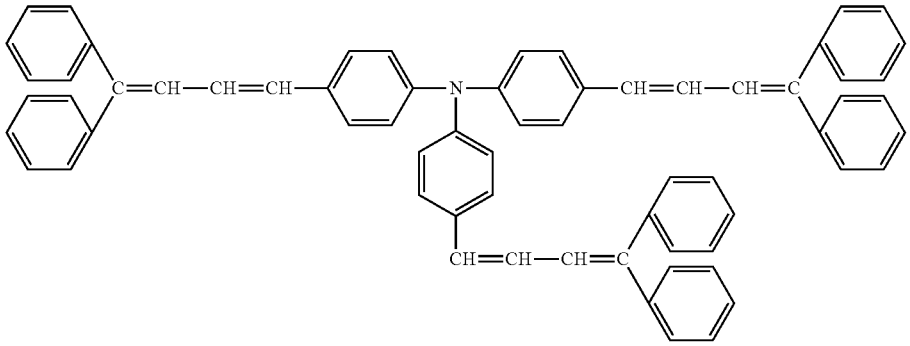

(CT2A)

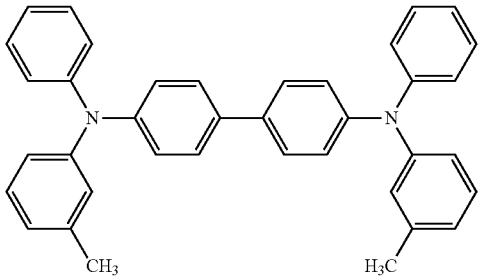

(HP-1)

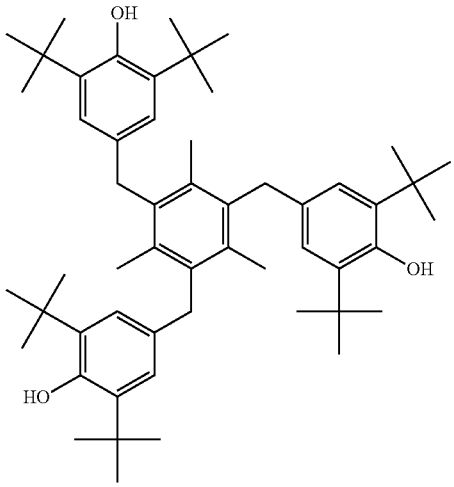

A photoreceptor is obtained through the above steps.

Examples 2 to 7

Photoreceptors are produced in the same manner as in Example 1 except that the shot peening conditions in the production of the conductive support are changed as described in Table 1.

Comparative Example 1

A photoreceptor is produced in the same manner as in Example 1 except that the shot peening is not performed in the production of the conductive support.

Comparative Example 2

A cylindrical tube made of a metal having an aluminum purity of 99.5% or more (JIS name: A1050 alloy) is produced by extrusion drawing and drawing, and the surface of the cylindrical tube is subjected to machining. Then opposite ends of the resulting cylindrical tube are cut off and subjected to end face treatment to obtain a conductive support having an outer diameter of 30 mm, a length of 253 mm, and a wall thickness of 0.4 mm. The undercoat layer, the charge generation layer, and the charge transport layer are formed on the conductive support in the same manner as in Example 1 to thereby obtain a photoreceptor.

Comparative Examples 3 to 6

Photoreceptors are produced in the same manner as in Example 1 except that the shot peening is not performed in the production of the conductive supports, but instead the cylindrical tubes are subjected to heat treatment under conditions described in Table 1.

<Evaluation>

Each of the photoreceptors in the Examples and Comparative Examples is installed in the DocuPrint P450ps manufactured by Fuji Xerox Co., Ltd., and image quality is evaluated as described below. The results are shown in Table 1. In the image forming apparatus, ring-shaped contact members for keeping the distance between the photoreceptor and the developing device within a prescribed range are in direct contact with the outer circumferential surface of the conductive support, as shown in FIG. 1. As the photoreceptor rotates, the contact members rotate together with the conductive support. The ring-shaped contact members are in contact with the 10 mm-wide areas of the conductive support onto which the zirconia beads have been projected.

[Density Unevenness]

Printing is performed on 10,000 sheets of A4 size paper in an environment of a temperature of 23° C. and a relative humidity of 55%, and then a halftone image with an image density of 30% is printed over the entire area of a sheet. The printed image is visually inspected and rated as follows.

G1: No density unevenness is found.

G2: Density unevenness is found, but the degree of the density unevenness is within a practically allowable range.

G3: Density unevenness is found, and the degree of the density unevenness is not practically allowable.

[Gradation]

Printing is performed on 10,000 sheets of A4 size paper in an environment of a temperature of 23° C. and a relative humidity of 55%. Then an image chart including halftone and solid images (black images) with image densities of 5%, 10%, 20%, 80%, 90%, and 100% is outputted. The images are visually inspected and rated as follows.

G1: The densities of the images do not differ from density settings.

G2: The densities of the images differ from the density settings, but the degree of the difference is within a practically allowable range.

G3: The densities of the images differ from the density settings, and the degree of the difference is not practically allowable.

[Durability of Conductive Supports]

Each of the photoreceptors in the Examples and Comparative Examples is installed in the DocuPrint P450ps manufactured by Fuji Xerox Co., Ltd. and rotated 800,000 times at a rotation speed of 340 rpm. After the rotation, the bare areas of the conductive support are visually inspected, examined by touch, and rated as follows. The results are shown in Table 1.

G1: No cracks are found. No dents are found in the areas in contact with the contact members.

G2: Fine cracks are found. However, no dents are found in the areas in contact with the contact members.

G3: Fine cracks are found. Slight dents are found in the areas in contact with the contact members.

G4: Propagation of cracks is found. Slight dents are found in the areas in contact with the contact members.

G5: Propagation of cracks is found. Obvious dents are found in the areas in contact with the contact members.

TABLE 1

| | | Shot peening or other treatment | | Surface residual stress of | Image quality evaluation | | Durability of |
|---|---|---|---|---|---|---|---|
| | Forming | Projection pressure | Projection time | conductive support | Density unevenness | Gradation | conductive support |
| Example 1 | Impact pressing → ironing | 0.3 MPa | 5 seconds | −10 MPa | G1 | G2 | G2 |
| Example 2 | Impact pressing → ironing | 0.3 MPa | 15 seconds | −20 MPa | G1 | G1 | G2 |
| Example 3 | Impact pressing → ironing | 0.3 MPa | 30 seconds | −30 MPa | G1 | G1 | G2 |
| Example 4 | Impact pressing → ironing | 0.3 MPa | 60 seconds | −40 MPa | G1 | G1 | G2 |
| Example 5 | Impact pressing → ironing | 0.3 MPa | 70 seconds | −50 MPa | G1 | G1 | G1 |
| Example 6 | Impact pressing → ironing | 0.3 MPa | 100 seconds | −55 MPa | G1 | G1 | G1 |
| Example 7 | Impact pressing → ironing | 0.3 MPa | 120 seconds | −70 MPa | G1 | G1 | G1 |
| Comparative Example 1 | Impact pressing → ironing | None | | −5 MPa | G2 | G2 | G2 |
| Comparative Example 2 | Extrusion drawing → drawing → machining | None | | 5 MPa | G2 | G2 | G4 |
| Comparative Example 3 | Impact pressing → ironing | Heat treatment at 200° C./1 hour | | 0 MPa | G3 | G3 | G5 |
| Comparative Example 4 | Impact pressing → ironing | Heat treatment at 250° C./1 hour | | 0 MPa | G3 | G3 | G5 |
| Comparative Example 5 | Impact pressing → ironing | Heat treatment at 300° C./1 hour | | 0 MPa | G3 | G3 | G5 |
| Comparative Example 6 | Impat pressing → ironing | Heat treatment at 350° C./1 hour | | 0 MPa | G3 | G3 | G5 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive support for an electrophotographic photoreceptor, the conductive support comprising:

a metallic cylindrical member, wherein the conductive support has a bare area exposed even after a photosensitive layer is disposed on the conductive support, and an outer circumferential surface of at least part of the bare area has a surface residual stress of about −10 MPa or less.

2. The conductive support for an electrophotographic photoreceptor according to claim 1, wherein the surface residual stress of the outer circumferential surface is about −30 MPa or less.

3. The conductive support for an electrophotographic photoreceptor according to claim 1, wherein the surface residual stress of the outer circumferential surface is about −70 MPa or more.

4. The conductive support for an electrophotographic photoreceptor according to claim 1, wherein the conductive support is made of a metal containing aluminum.

5. The conductive support for an electrophotographic photoreceptor according to claim 1, wherein the surface residual stress of the outer circumferential surface of the at least part of the bare area exposed even after the photosensitive layer is disposed is about −10 MPa or less over an entire circumference of the outer circumferential surface.

6. The conductive support for an electrophotographic photoreceptor according to claim 5, wherein the surface residual stress of the outer circumferential surface is about −30 MPa or less.

7. The conductive support for an electrophotographic photoreceptor according to claim 5, wherein the surface residual stress of the outer circumferential surface is about −70 MPa or more.

8. The conductive support for an electrophotographic photoreceptor according to claim 5, wherein the conductive support is made of a metal containing aluminum.

9. An electrophotographic photoreceptor comprising:

a conductive support including a metallic cylindrical member; and a photosensitive layer disposed on the conductive support, wherein the conductive support has a bare area, and an outer circumferential surface of at least part of the bare area has a surface residual stress of about −10 MPa or less.

10. The electrophotographic photoreceptor according to claim 9, wherein the surface residual stress of the outer circumferential surface is about −30 MPa or less.

11. The electrophotographic photoreceptor according to claim 9, wherein the surface residual stress of the outer circumferential surface is about −70 MPa or more.

12. The electrophotographic photoreceptor according to claim 9, wherein the conductive support is made of a metal containing aluminum.

13. The electrophotographic photoreceptor according to claim 9, wherein the surface residual stress of the outer circumferential surface of the at least part of the bare area of the conductive support is about −10 MPa or less over an entire circumference of the outer circumferential surface.

14. The electrophotographic photoreceptor according to claim 13, wherein the surface residual stress of the outer circumferential surface is about −30 MPa or less.

15. The electrophotographic photoreceptor according to claim 13, wherein the surface residual stress of the outer circumferential surface is about −70 MPa or more.

16. The electrophotographic photoreceptor according to claim 13, wherein the conductive support is made of a metal containing aluminum.

17. An image forming apparatus comprising:

the electrophotographic photoreceptor according to claim 9;

a contact member that is in direct contact with a region of the outer circumferential surface of the conductive support of the electrophotographic photoreceptor, the region having a surface residual stress of about −10 MPa or less;

a charging unit configured to charge a surface of the electrophotographic photoreceptor;

an electrostatic latent image forming unit configured to form an electrostatic latent image on the charged surface of the electrophotographic photoreceptor;

a developing unit that configured to develop the electrostatic latent image formed on the surface of the electrophotographic photoreceptor using a developer containing toner to thereby form a toner image; and a transfer unit configured to transfer the toner image onto a surface of a recording medium.

* * * * *